US009615674B2

(12) United States Patent
Vitollo et al.

(10) Patent No.: US 9,615,674 B2
(45) Date of Patent: Apr. 11, 2017

(54) CAN DISPENSER AND MERCHANDISER

(71) Applicants: Mark Vitollo, Middletown, NJ (US); George Mitchell, Mendham, NJ (US); Bella Gutman, Morganville, NJ (US)

(72) Inventors: Mark Vitollo, Middletown, NJ (US); George Mitchell, Mendham, NJ (US); Bella Gutman, Morganville, NJ (US)

(73) Assignee: TRINITY, LLC, Metuchen, NJ (US)

( * ) Notice: Subject to any disclaimer, the term of this patent is extended or adjusted under 35 U.S.C. 154(b) by 0 days.

(21) Appl. No.: 15/067,943

(22) Filed: Mar. 11, 2016

(65) Prior Publication Data

US 2016/0262554 A1 Sep. 15, 2016

Related U.S. Application Data

(60) Provisional application No. 62/131,682, filed on Mar. 11, 2015.

(51) Int. Cl.
*A47F 1/04* (2006.01)
*A47F 1/08* (2006.01)

(52) U.S. Cl.
CPC ..... *A47F 1/087* (2013.01); *A47F 1/04* (2013.01)

(58) Field of Classification Search
CPC ..... A47F 1/04; A47F 1/087
USPC ..... 211/59.2, 59.3, 74; 312/42, 45, 60, 72; 206/427, 429; 220/553
See application file for complete search history.

(56) References Cited

U.S. PATENT DOCUMENTS 265,400 A * 10/1882 Fitch ..... B65D 83/0409 211/59.2
348,164 A * 8/1886 Judson ..... A47F 1/08 312/290
916,027 A * 3/1909 Sausser ..... E21F 1/10 246/304
1,663,088 A * 3/1928 Matheson ..... A47F 1/08 312/42
1,753,957 A * 4/1930 Washburn ..... A47F 1/08 221/287
2,382,191 A * 8/1945 Weichselbaum ..... A47F 1/087 193/27
2,805,111 A * 9/1957 Jarnot ..... A24F 27/10 248/314

(Continued)

FOREIGN PATENT DOCUMENTS

KR WO 2015083847 A1 * 6/2015 ..... A47F 1/087

*Primary Examiner* — Joshua J Michener
*Assistant Examiner* — Devin Barnett
(74) *Attorney, Agent, or Firm* — Cozen O'Connor

(57) ABSTRACT

A dispenser is provided for storing and individually dispensing cylindrical containers in a vertical orientation. The dispenser includes an upper chamber having a ramp sloping downward toward a back of the dispenser, which receives the containers loaded in a vertical orientation at a front of the dispenser. The containers move down the upper chamber ramp by gravity to an opening at a back end of the dispenser, through which the containers pass to a lower chamber. The lower chamber has a ramp sloping downward toward the front of the dispenser. The containers move down the lower chamber ramp by gravity to a dispensing position at the front of the dispenser. A latch is positioned at a back portion of the upper chamber to restrict passage of the containers so that they pass through the opening one at a time as containers are removed from the dispensing position.

16 Claims, 12 Drawing Sheets

(56) References Cited

U.S. PATENT DOCUMENTS 2,996,344 A * 8/1961 Garman ..... A47F 1/087 229/122
3,318,455 A * 5/1967 Takahashi ..... A47F 1/087 211/59.2
3,464,589 A * 9/1969 Oden ..... G07F 11/32 221/295
3,501,016 A * 3/1970 Eaton ..... A47F 7/28 211/49.1
3,502,382 A * 3/1970 Rainey ..... A47F 1/082 221/251
3,570,711 A * 3/1971 Young, Jr. ..... B65B 43/205 221/295
3,938,700 A * 2/1976 Camp ..... G07F 11/32 193/32
3,970,216 A * 7/1976 Rainey ..... G07F 11/16 221/125
4,098,383 A * 7/1978 Carpman ..... B65D 71/00 193/2 R
4,105,126 A * 8/1978 Deffner ..... A47F 1/12 211/59.2
4,356,923 A * 11/1982 Young ..... A47F 7/28 211/184
4,474,297 A * 10/1984 Zucker ..... A47F 1/12 211/184
4,834,263 A * 5/1989 Becze ..... G07F 11/34 221/1
4,896,792 A * 1/1990 Marchand ..... G07F 11/10 221/103
4,997,106 A * 3/1991 Rockola ..... G07F 11/34 211/59.2
4,998,628 A * 3/1991 Ross ..... A47F 1/087 211/59.2
5,080,256 A * 1/1992 Rockola ..... G07F 11/34 193/2 A
5,176,288 A * 1/1993 Craven ..... B65G 33/04 221/124
5,251,784 A * 10/1993 Chacon Sevila .... B65G 59/062 221/220
5,314,078 A * 5/1994 Morikiyo ..... A47F 1/087 211/59.2
5,396,997 A * 3/1995 Johnson ..... A47F 1/087 211/59.2
5,413,229 A * 5/1995 Zuberbuhler ..... A47F 1/125 211/51
5,700,075 A * 12/1997 Perone ..... A47F 1/08 221/131
5,806,712 A * 9/1998 Siemsen ..... G07F 11/28 211/59.2
5,904,256 A * 5/1999 Jay ..... A47F 5/0025 211/175
6,206,237 B1 * 3/2001 Dillon ..... B65G 1/08 221/193
6,321,934 B1 * 11/2001 Immel ..... A47F 1/12 221/192
6,612,525 B2 * 9/2003 Bagdi ..... F16B 21/02 248/71
6,637,604 B1 * 10/2003 Jay ..... A47F 1/12 211/59.2
7,513,390 B2 * 4/2009 Artsiely ..... G07F 11/30 221/151
7,690,518 B2 * 4/2010 Fincher ..... A47F 1/12 211/59.2
7,850,015 B1 * 12/2010 Mason ..... A47F 1/087 211/175
7,913,860 B2 * 3/2011 Merl ..... G07F 11/16 211/59.2
7,918,365 B2 * 4/2011 White ..... A47F 1/087 221/123
7,922,437 B1 * 4/2011 Loftin ..... A47F 1/087 229/122.2
8,047,400 B1 * 11/2011 Luberto ..... A47F 1/087 221/194
8,308,023 B2 * 11/2012 Gelardi ..... A47F 1/087 221/31
8,448,815 B2 * 5/2013 Sholl ..... A47F 1/08 221/15
8,550,261 B2 * 10/2013 Loftin ..... A47F 1/087 211/59.2
8,657,126 B1 * 2/2014 Loftin ..... A47F 1/087 211/59.2
8,668,114 B2 * 3/2014 Gelardi ..... A47F 1/087 211/59.2
8,757,433 B2 * 6/2014 Machers ..... G07F 11/20 211/59.2
8,827,111 B2 * 9/2014 Johnson ..... A47F 1/087 221/124
8,833,601 B2 * 9/2014 Zacherle ..... B65D 71/36 221/30
8,925,744 B1 * 1/2015 Jang ..... A47F 1/12 211/126.12
9,174,785 B2 * 11/2015 Gelardi ..... A47F 1/087
9,320,365 B2 * 4/2016 Fortuna ..... A47F 1/087
2002/0179553 A1 * 12/2002 Squitieri ..... A47F 5/005 211/59.2
2003/0141313 A1 * 7/2003 Bates ..... B65D 71/36 221/32
2004/0011751 A1 * 1/2004 Johnson ..... A47F 1/087 211/59.2
2004/0020877 A1 * 2/2004 Boron ..... A47F 1/12 211/59.2
2004/0200789 A1 * 10/2004 Woodbury ..... A47F 1/087 211/59.2
2005/0127014 A1 * 6/2005 Richter ..... A47F 1/126 211/59.2
2005/0127015 A1 * 6/2005 Medcalf ..... A47F 7/28 211/59.2
2005/0184444 A1 * 8/2005 An ..... B65H 1/02 271/10.03
2007/0007221 A1 * 1/2007 Mann ..... A47F 1/126 211/59.3
2007/0075028 A1 * 4/2007 Nagel ..... A47F 3/0486 211/59.2
2007/0119798 A1 * 5/2007 Hanretty ..... A47F 1/12 211/59.2
2007/0194037 A1 * 8/2007 Close ..... B65D 5/5213 221/100
2008/0011696 A1 * 1/2008 Richter ..... A47F 1/126 211/59.2
2008/0156751 A1 * 7/2008 Richter ..... A47F 1/126 211/59.2
2009/0212066 A1 * 8/2009 Bauer ..... A47F 1/087 221/281
2010/0032391 A1 * 2/2010 Schneider ..... A47F 5/10 211/59.2
2010/0295424 A1 * 11/2010 Alexander ..... A47F 1/087 312/109
2010/0307992 A1 * 12/2010 Robertson ..... A47F 5/0043 211/59.2
2011/0121011 A1 * 5/2011 Gelardi ..... A47F 1/08 221/30
2011/0147323 A1 * 6/2011 Sainato ..... A47F 1/12 211/59.2
2012/0018391 A1 * 1/2012 Gelardi ..... A47F 1/087 211/59.2
2012/0067835 A1 * 3/2012 Danehy ..... A47F 5/005 211/59.3
2012/0266437 A1 * 10/2012 Camello ..... A47F 1/125 29/428
2013/0134119 A1 * 5/2013 Loftin ..... A47F 5/0025 211/59.2
2013/0270203 A1 * 10/2013 Burton ..... A47F 1/087 211/59.2
2014/0054249 A1 * 2/2014 Loftin ..... A47F 1/087 211/59.2
2014/0054309 A1 * 2/2014 Loftin ..... A47F 1/087 221/1
2014/0190912 A1 * 7/2014 Bauer ..... A47F 1/087 211/59.2

(56) References Cited

U.S. PATENT DOCUMENTS

| | | | | |
|---|---|---|---|---|
| 2015/0021283 | A1* | 1/2015 | Bruegmann | A47F 1/12<br>211/59.2 |
| 2016/0058204 | A1* | 3/2016 | Bernard | A47F 1/087<br>211/59.2 |
| 2016/0185509 | A1* | 6/2016 | Bittinger | B65D 5/72<br>312/42 |

* cited by examiner

CAN DISPENSER AND MERCHANDISER

CROSS-REFERENCE TO RELATED APPLICATION

This application claims priority to U.S. Provisional Patent Application No. 62/131,682, entitled "Can Dispenser and Merchandiser", filed Mar. 11, 2015, which is incorporated herein by reference in its entirety.

FIELD OF THE INVENTION

The disclosed embodiments relate to a can dispenser and merchandiser. In particular, the disclosed embodiments relate to a can disperser and merchandiser which stores and individually dispenses cans in a vertical orientation.

BACKGROUND OF THE INVENTION

Merchandising dispensers are used in retail environments, such as grocery stores, to store and dispense cans of food products, such as, for example, soups, beverages, etc. Conventional dispensers store and dispense cans which are in a horizontal orientation, i.e., the axes of the cylindrical cans are horizontally oriented. Such dispensers may store the cans side-by-side on an angled ramp inside the dispenser, so that they roll down to the dispensing output on the front surface of the dispenser through the force of gravity as cans are removed from the dispenser by the consumer.

However, in conventional dispensers, the product is viewed by the consumer in its horizontal orientation prior to selection and dispensing, rather than in a vertical orientation corresponding to the label on the product. This can make it difficult for the consumer to identify the product and is detrimental to the shopping experience. Also, displaying products in the horizontal orientation reduces the effectiveness of the label design, which can be an important component of the product's brand identity and marketing strategy. Moreover, the horizontal orientation of the product is at odds with conventional retail displays of vertically-oriented cans on a fixed shelf, which may result in dissonance in the consumer's perception and recollection of the product's label.

SUMMARY OF THE INVENTION

A can merchandising dispenser provides for the feeding of canned goods in a vertical orientation (as opposed to a horizontal one) so as to provide automatic front-facing of product in an upright manner. In the disclosed embodiments, first-in-first-out movement of cans on a dispenser shelf is provided with little or no shelf maintenance by store associates for installing or maintaining the dispenser, other than loading and reloading the dispenser with canned product. By providing a vertical can merchandising system versus the horizontal-type merchandiser of the prior art, the number of product facings presented to the shopper can be increased in a given horizontal space. In other words, because the diameter of canned goods is smaller than the height of the cans, the vertical positioning of canned goods in a dispenser occupies less horizontal space, as compared to known horizontal feed dispensers. Moreover, the product labeling on the cans can be presented to the shopper in the intended vertical/upright orientation as opposed to the horizontal orientation of the prior art merchandising dispensers.

Cans may be loaded in a top or upper chamber, whereby the can(s) move along a floor, such as an inclined ramp, while rotating about a longitudinal axis of the can (e.g., in a clockwise direction, etc.), and then are dropped one-by-one to a bottom or lower chamber with the help of a latch to ultimately be presented to the shopper for sale. As a front can is removed, other cans behind the front can move forward. The upper chamber includes opposing guide ribs, e.g., one at an upper left side of the upper chamber and another at a lower right side of the upper chamber. Alternatively, the guide ribs can be positioned such that the upper one is on the right side and the lower one on the left side. The guide ribs facilitate rotation of the cans by providing a slight tilt to the cans along a bottom edge of the cans with respect to the ramp as the cans move down, under the force of gravity, toward an intermediate section and then toward the lower chamber. Thus, a continuous path is presented from the upper chamber, through the intermediate section, and then through the lower chamber.

It has been discovered that by providing a tilt angle to the cans via the guide ribs in a direction that is not parallel to the direction of translational motion of the can along the floor, and by causing a rotational motion to be imparted to the can, the angle of incline of the floor of the upper chamber can be reduced, i.e., the angle need not be as steep as would otherwise be required without rotational motion. This yields a benefit that the overall height of the dispenser can be shorter because of the can rotation, as opposed to the height required without can rotation.

Guide ribs may optionally be included in the lower chamber as well, e.g., a lower chamber guide rail (i.e., guide rib) at the top, left-side of the lower chamber, and another guide rail/rib at the bottom, right-side of the lower chamber to impart a tilt angle to the cans in the lower chamber and facilitate movement of the cans along the lower chamber.

As the cans move along the floor of the upper chamber and rotate as a result of the tilt angle imparted by the diametrically-opposing upper chamber guide ribs, the bottom of the cans will enter an intermediate section. In this region, the bottom of the cans will interact with an opening in the angled floor (also referred to as an interrupted floor).

At the forward end of the lower chamber a "stop" is positioned, such as a tab, which prevents forward movement of the cans at the end of the travel path. The stop thus positions the cans in a dispensing position for access by a shopper. When a shopper removes the front can, the remaining cans advance downward such that the second can is now in position for removal by a shopper, and so on.

Optionally, a middle chamber for additional cans is provided. The middle chamber is positioned between the upper and lower chambers of the merchandiser and will receive cans in the upright position for dispenser and purchase by a shopper. The cans in the middle chamber are front-loaded, i.e., they are loaded into the middle chamber in a first-in-last-out manner from the front of the merchandiser. The middle chamber may also include guide rails, e.g., at the top right side of the chamber and the bottom left-side of the chamber, to impart a tilt angle to the cans to facilitate downward movement along the middle chamber. As with the upper and lower chambers, the guide rails facilitate movement of the cans toward a forward direction such that the incline angle of the middle chamber floor can be lessened.

The construction of the dispenser is preferably by injection molding. The design entails two halves with the floors molded to the sides. The two sides will be coupled together to form a front facing dispenser chute. Multiple merchandising dispenser chutes, i.e., slots, can be placed side-by-side and/or in a vertically stacked orientation on a merchandising shelf, such as at a supermarket, wherein each dispenser slot may include a particular product. For example, one dispenser slot may include cans of tomato soup and an adjacent dispenser slot may include cans of chicken soup.

The combination of the above features allows for a can to be stored and dispensed in a vertical orientation, as it would be displayed on a store shelf. The can is loaded, stored, and then moves through the merchandising dispenser while maintaining a vertical orientation. The cans are then presented to a shopper in a vertical orientation in the dispensing position.

In one aspect, the present invention provides a dispenser for storing and individually dispensing cylindrical containers in a vertical orientation. The dispenser includes an upper chamber having a ramp sloping downward toward a back of the dispenser. The upper chamber is configured to receive the containers loaded in a vertical orientation at a front of the dispenser and which move down the upper chamber ramp by gravity. The upper chamber ramp has an opening at a back end of the dispenser through which the containers pass. The dispenser further includes a lower chamber having a ramp sloping downward toward the front of the dispenser and configured to receive the containers passing through the opening in the upper chamber ramp. The containers move down the lower chamber ramp by gravity to a dispensing position at the front of the dispenser. The dispenser further includes a latch positioned at a back portion of the upper chamber which is configured to restrict passage of the containers through the opening in the upper chamber ramp so that the containers pass through the opening one at a time as containers are removed from the dispensing position.

Embodiments of the present invention may include one or more of the following features.

The ramp of the lower chamber may be sized to fit a whole number of the containers plus a fractional portion of one of the containers. The lower chamber may be configured so that a container passing through the opening in the upper chamber ramp lodges in an intermediate position between the upper chamber and the lower chamber when the lower chamber is filled with the containers.

The latch may include: a lever having a fulcrum fixed at the back portion of the upper chamber; and an elastic element connected to an upper end of the lever and the back portion of the upper chamber above the fulcrum, the elastic element being configured to apply a tension force to the upper end of the lever. The elastic element may be a spring or elastic band. The elastic element may be configured to pull the upper end of the lever out of a path of the containers descending the ramp of the upper chamber as the lever rotates about the fulcrum in a first direction.

The lever may include a lower end on a side of the fulcrum opposite the upper end of the lever, the lower end of the lever being configured to move the upper end of the lever into the path of the containers descending the ramp of the upper chamber, when the lower end of the lever is pushed toward a back portion of the lower chamber, as the lever rotates about the fulcrum in a second direction opposite to the first direction. The lower end of the lever may be configured to be pushed toward the back portion of the lower chamber when a container passes through the opening in the upper chamber ramp.

The upper chamber may be configured to provide a tilt angle, in a direction transverse to the longitudinal direction of the upper chamber, of the vertically-oriented containers as the containers pass through the upper chamber. The tilt angle may be sufficient to cause each of the containers to contact the ramp of the upper chamber on an edge of a bottom rim of the container to allow rotation of the container as it passes through the upper chamber while maintaining a substantially vertical orientation of the container. The tilt angle may be between about 0.5 degree and about 5 degrees, or between about 1 degree and about 3 degrees.

The upper chamber may include a first guide rib extending along an upper portion of a first side wall of the upper chamber in a longitudinal direction of the upper chamber, the first guide rib being configured to impart a tilt angle to the containers. The upper chamber may further include a second guide rib extending along a lower portion of a second side wall of the upper chamber in a longitudinal direction of the upper chamber, the second guide rib being configured, in conjunction with the first guide rib, to impart a tilt angle to the containers.

The upper chamber may include a first guide rib extending along a first side wall and a second guide rib extending along a second side wall of the upper chamber in a longitudinal direction of the upper chamber. A distance between the first and second guide ribs in a transverse direction of the upper chamber may be less than a diameter of the containers.

The dispenser may be formed by joining two side panels, each of the side panels having structures extending from at least one face, the structures forming the ramps of the upper and lower chambers.

In another aspect, the present invention provides a multiple-slot dispenser for storing and individually dispensing cylindrical containers from each of the slots in a vertical orientation. The multiple-slot dispenser includes a number of the dispensers discussed above connected in a side-by-side arrangement.

In particular embodiments, the multiple-slot dispenser may include a loading door extending across an upper portion of the slots, the loading door being hinged to provide access to a loading opening at the front of the upper chamber of each of the slots. Each of the slots may be formed by joining two side panels, each of the side panels having structures extending from at least one face, the structures forming the ramps of the upper and lower chambers of each slot. Internal ones of the side panels each may have structures extending from both faces thereof, the structures of adjacent ones of the internal side panels forming, in conjunction, the ramps of the upper and lower chambers of the slots formed between the internal side panels.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION

Figure 1:
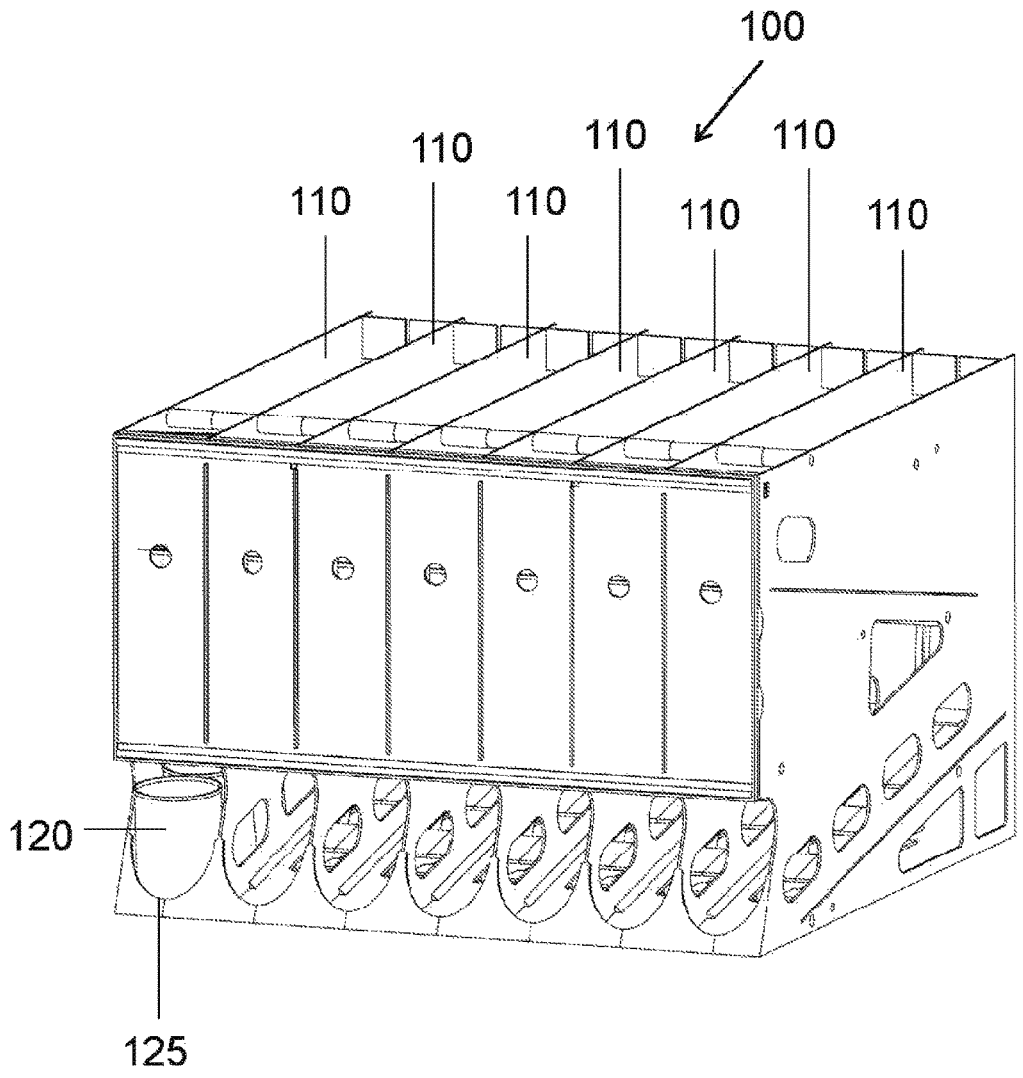
FIG. 1 shows a perspective view of an embodiment of a multiple-slot can dispenser and merchandiser which, in each slot, stores and individually dispenses cans in a vertical orientation.

FIG. 1 shows a perspective view of an embodiment of a multiple-slot can dispenser and merchandiser 100 which, in each slot 110, stores and individually dispenses cylindrical containers, e.g., cans 120, in a vertical orientation. The dispenser 100 is typically used in a retail environment, such as, for example, a grocery store or delicatessen, to display a set of canned products, e.g., various flavors of soup. The dispenser 100 may also be used as a point-of-sale display near a check-out counter. A seven-slot 110 version of the dispenser 100 is depicted in FIG. 1, but any number of slots 110, including only a single slot, may be implemented using the embodiments disclosed herein. In this example, the first (i.e., left-most) slot 110 of the dispenser is depicted with cans 120 loaded therein. A forward-most, next to-be-dispensed can rests in an opening at the front bottom edge of the slot, which serves as a dispensing position 125 from which the consumer can remove a single vertically-oriented can of the product. The dispenser 100 is open on top because it is normally positioned between existing shelves in a retail establishment. In particular embodiments, e.g., a countertop display, a top panel (not shown) may be provided to cover the top of the dispenser 100.

Figure 2:
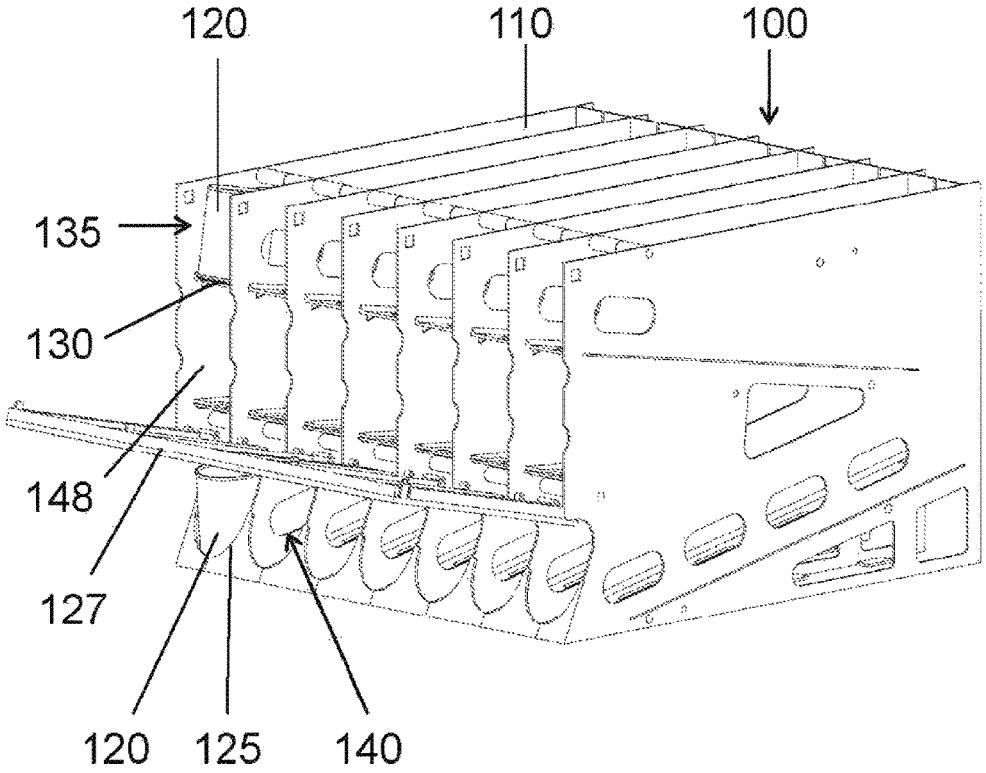
FIG. 2 shows the multiple-slot can dispenser and merchandiser of FIG. 1 with the loading door open to allow access to load the slots with cans.

FIG. 2 shows the multiple-slot can dispenser and merchandiser 100 of FIG. 1 with the loading door 127 open to allow access to load the slots 110 with cans 120. The loading door 127 is opened by an employee of the retail establishment to reload the slots 110 with additional cans of product. The cans 120 are loaded on a ramp 130 which forms the floor of an upper chamber 135 of the slot 110. As described in further detail below, as the cans 120 are loaded, they move forward in the slot 110 down to the lower chamber 140 and, finally, to the dispensing position 125. Loading door 127 depicted in this embodiment is a single door which allows access to all of the slots 110 of the multiple-slot dispenser 100 but, in particular embodiments, each slot 110 may have a separate door. Furthermore, the loading door 127 is a tilt-down, top-opening door in this example, but other configurations, such as a side-opening or bottom-opening door (s), may be used.

In particular embodiments, there may also be a middle chamber 148 in each slot 110 into which product may be loaded. The product loaded into the middle chamber 148 does not progress to the dispensing position 125, but may be stored temporarily in the middle chamber 148 and then moved to the upper chamber 135 loading position by an employee of the retail establishment. Alternatively, the middle chamber 148 may include a forwardly-sloping ramp (not shown) so that cans placed in the middle chamber 148 will move toward the front of the dispenser 100 in a manner similar to the movement of cans 120 in the upper 135 and lower chambers 140, which is discussed in detail below. In such a case, a stop (not shown) is provided at the front of the middle chamber 148 to maintain the cans of the middle chamber in a dispending position.

Figure 3:
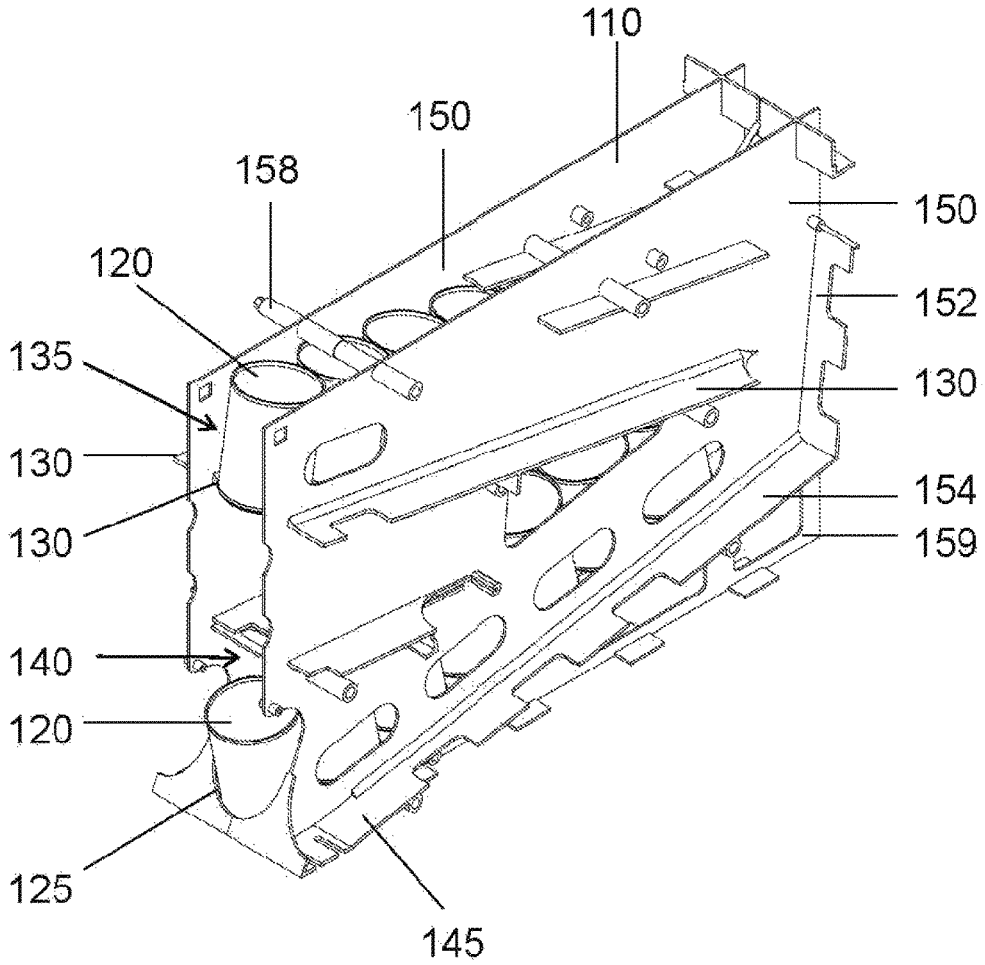
FIG. 3 shows a perspective view of one slot of the can dispenser and merchandiser loaded with cans.

FIG. 3 shows a perspective view of one slot 110 of the dispenser and merchandiser 100 loaded with cans 120. Each of the side panels 150 of the slot 110 provides structures to form the ramp 130 of the upper chamber 135, a back panel 152 of the dispenser, a bottom panel 154 of the dispenser, which also serves as the ramp 145 of the lower chamber 140, interconnection elements, e.g., threaded bosses 158, for joining side panels 150, and rigid members for forming a base 159 of the dispenser. The slot 110 depicted in this example is an internal slot of a multiple-slot dispenser. Therefore the side panels 150 have structures extending from both sides in opposing directions, so that any number of internal slot side panels 150 may be interconnected to form a multiple-slot dispenser. The outermost side panels 150 on the left and right sides of the dispenser have structures extending from only one surface (i.e., face) of the side panel, i.e., they only have structures extending from an inward facing surface, leaving flat outward facing surfaces on the left and right sides of the dispenser, as shown in FIGS. 1 and 2.

Figure 4:
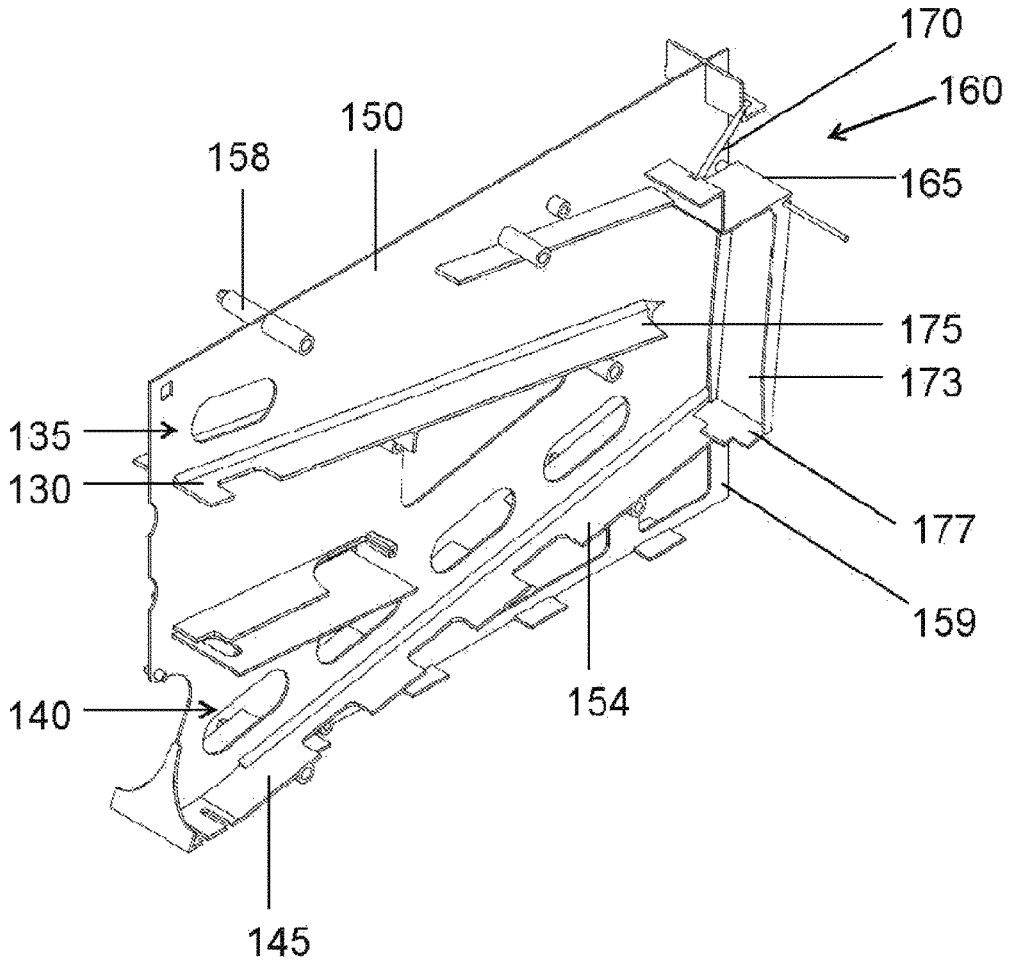
FIG. 4 shows a perspective view of a side panel having extending structures for forming, in conjunction with another side panel, an internal slot of the can dispenser and merchandiser.

FIG. 4 shows a perspective view of a side panel 150 having extending structures for forming, in conjunction with another side panel 150, an internal slot 110 of the can dispenser and merchandiser 100. As in FIG. 3, the side panel 150 provides structures to form the ramp 130 of the upper chamber 135, a back panel of the dispenser 152 (see FIG. 3), a bottom panel 154 of the dispenser, which also serves as the ramp 145 of the lower chamber 140, interconnection elements 158 for joining side panels 150, and rigid members for forming a base 159 of the dispenser. This figure also shows a latch 160, which includes a lever 165, a moveable backstop 167, and an elastic element 170, e.g., a spring or elastic band, installed on the side panel 150. The latch 160, and its operation, are discussed in further detail below.

Figure 5:
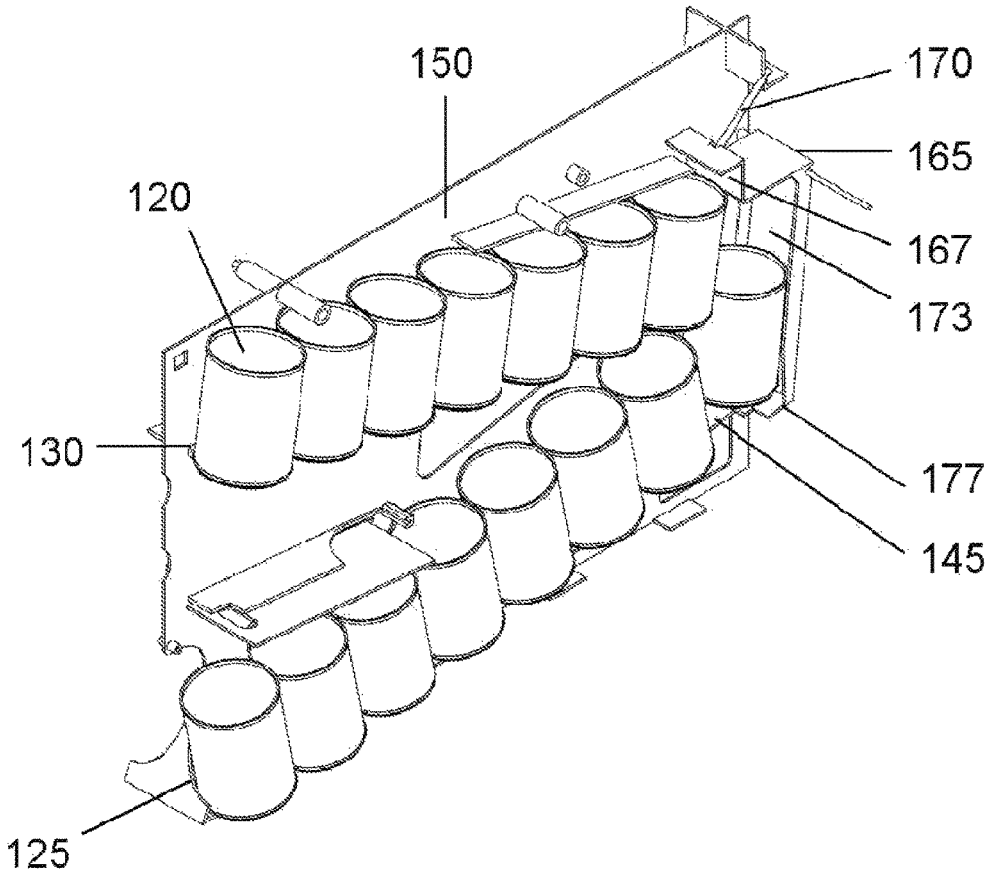
FIG. 5 shows the side panel depicted in FIG. 4 loaded with cans.

FIG. 5 shows the side panel 150 depicted in FIG. 4 loaded with cans 120. A fully-loaded slot 110 is depicted in this example. A series of cans 120 extends from the loading opening of the upper chamber ramp 130, along the upper chamber ramp 130, through a drop-down opening 175 (see FIG. 4) in the upper chamber ramp 130, along the lower chamber ramp 145, and ending in a dispensing position 125 at the forward, bottom edge of the slot 110. The movement of the cans along this path is described in detail below.

FIGS. 6A-6D depict a can movement sequence in one slot 110 of the dispenser as a can 605 is removed from the front of the dispenser by a consumer. The cans 120 rest on an inclined floor, i.e., ramp 130, of the upper chamber 135. The ramp 130 is angled in a downward direction away from the front 610 of the slot 110. As discussed in further detail below, the ramp has guide ribs (not shown) which impart a tilt angle to the cans 120 with respect to the ramp in a sideways, i.e., transverse, direction with respect to the ramp, resulting in each can contacting the ramp only on one edge of its bottom rim. This configuration causes the cans to roll on the edge of their bottom rims and rotate as they move down the ramp 130 of the upper chamber 135 toward the back 615 of the slot 110.

Figure 6A:
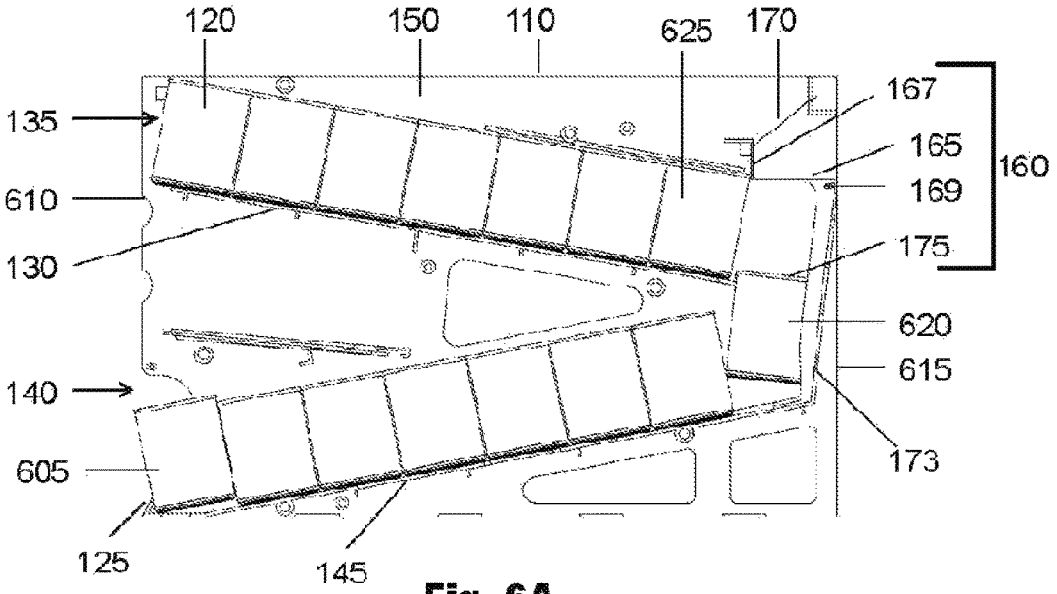
FIGS. 6A-6D depict a can movement sequence as a can is removed from the front of the dispenser by a consumer.

As shown in FIG. 6A, when the lower chamber 140 of the slot 110 is fully loaded with cans 120, so that a can 605 is in the dispensing position 125 at the front bottom edge of the slot 110, the bottom of the last can 620 in the upper chamber 135 is received in the interrupted floor, i.e., opening 175 at the end of the ramp 130 of the upper chamber 135. However, the can 620 which has dropped through the opening 175 cannot completely fit on the ramp 145 of the lower chamber 140 and thus assumes an intermediate position between the upper 135 and lower chambers 140.

As further shown in FIG. 6A, a latch 160 is configured to insert a movable backstop 167 to stop the can 625 immediately preceding the can 620 in the intermediate position to ensure that only one can at a time passes through the opening 175. The backstop 167 forms one end of the lever 165 which pivots about a fulcrum 169 at the back of the upper chamber 135. As a can 620 moves into the intermediate position, an actuating portion 173 of the lever 165 is pushed backward toward the back of the lower chamber 125, which, in turn, causes the backstop 167 to move downward into the path of the cans (e.g., 625) on the ramp 130 of the upper chamber 135. The backstop 167 moves downward far enough to catch the top edge of the immediately preceding can 625. The timing of this movement of the lever 165 is such that the backstop 167 is in its stopping position before the immediately preceding can 625 passes the stopping position of the backstop 167.

Figure 6B:
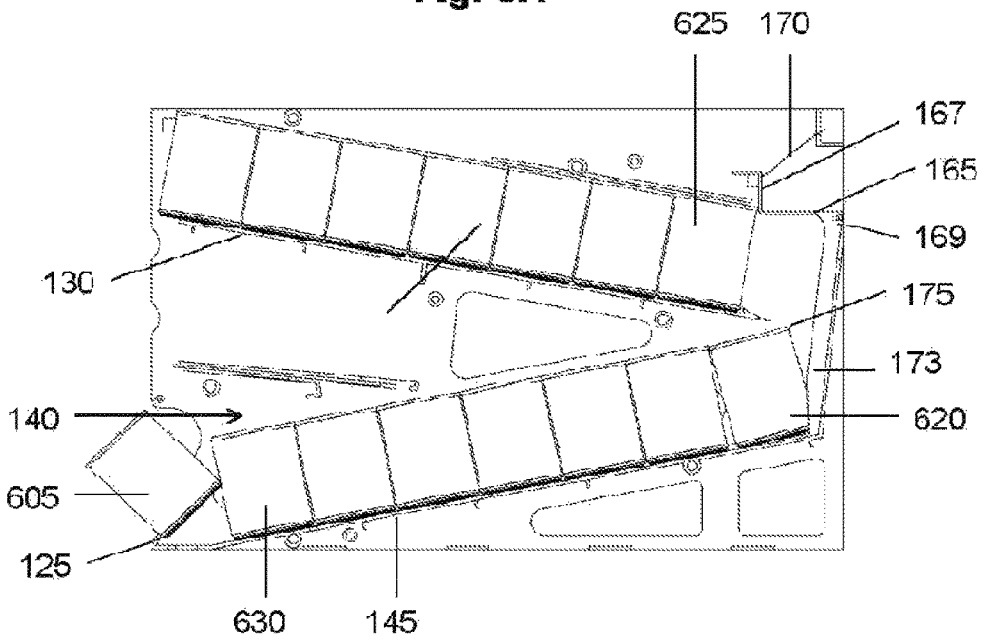

As shown in FIG. 6B, as the consumer begins to remove a can 605 from the dispensing position 125 at the front bottom edge of the slot 110, the cans on the lower ramp 145 move forward, which causes the can 620 in the intermediate position to completely enter the lower chamber 140. The forward movement of the cans along the bottom ramp 145 can be solely under the force of gravity or can be assisted, as in the upper chamber 135, by guide ribs (not shown), discussed in further detail below, positioned in the lower chamber to impart a tilt angle to the cans for rotational movement. A stop 629 is positioned at the end of the lower chamber bottom ramp so that the next, forward-most can 630 comes to rest in its final position, i.e., the dispensing position 125 (see FIG. 6C).

Figure 6C:
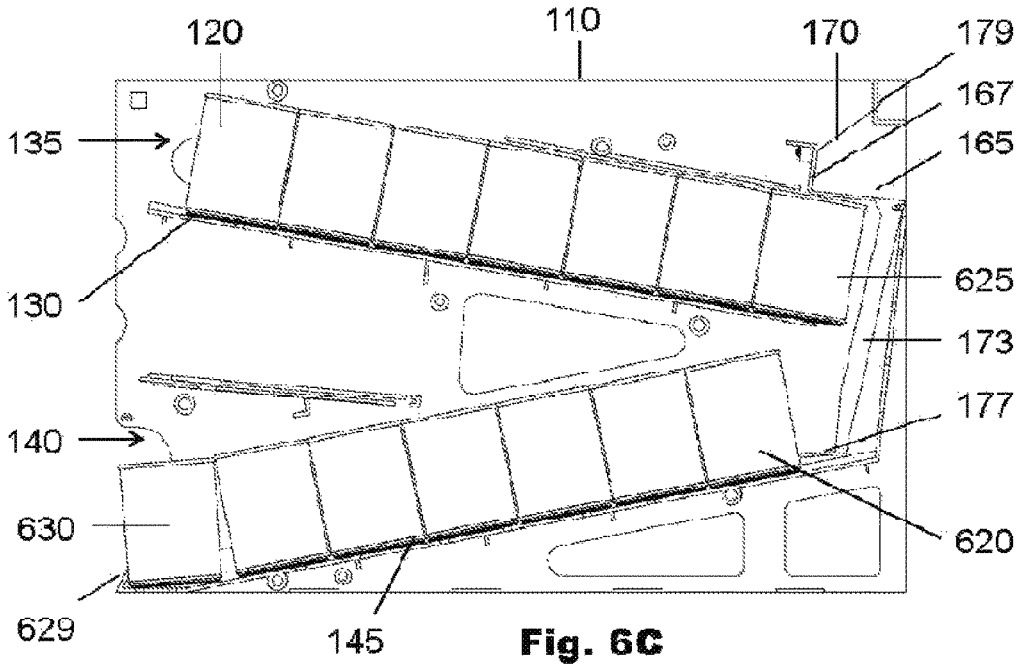

As shown in FIG. 6C, once the can 605 in the dispensing position 125 (i.e., the can depicted in the dispensing position in FIGS. 6A and 6B) has been completely removed by the consumer, the can 620 which has dropped from the intermediate position moves forward on the ramp 145 of the lower chamber 140, thereby allowing a bottom edge 177 of the actuating portion 173 of the lever 165 to move forward. The forward movement is forced by an elastic element 170, e.g., a spring or elastic band, attached between the movable backstop 167 and an anchoring point 179 in an upper back corner of the slot 110. The elastic member 170 creates tension which tends to pull the movable backstop 167 into its upper position. This, in turn, allows the immediately preceding can 625 to move beyond the backstop 167.

The tension and size of the elastic member 170 may be determined based on the size and weight of the cans being dispensed. As discussed above, the elastic member 170 is attached to the lever 165 (and, in particular, to the backstop 167) and assists with the pivoting motion that provides jam-proof functionality. The elastic member 170 and lever 165 are preferably designed to be easily replaceable after installation of the dispenser in stores. The latch 160 described above, with its component lever 165, and other components described above, can also be used with various other gravity-fed, product dispensing systems, such as, for example, simple sliding can systems, roller pin systems, etc.

Figure 6D:
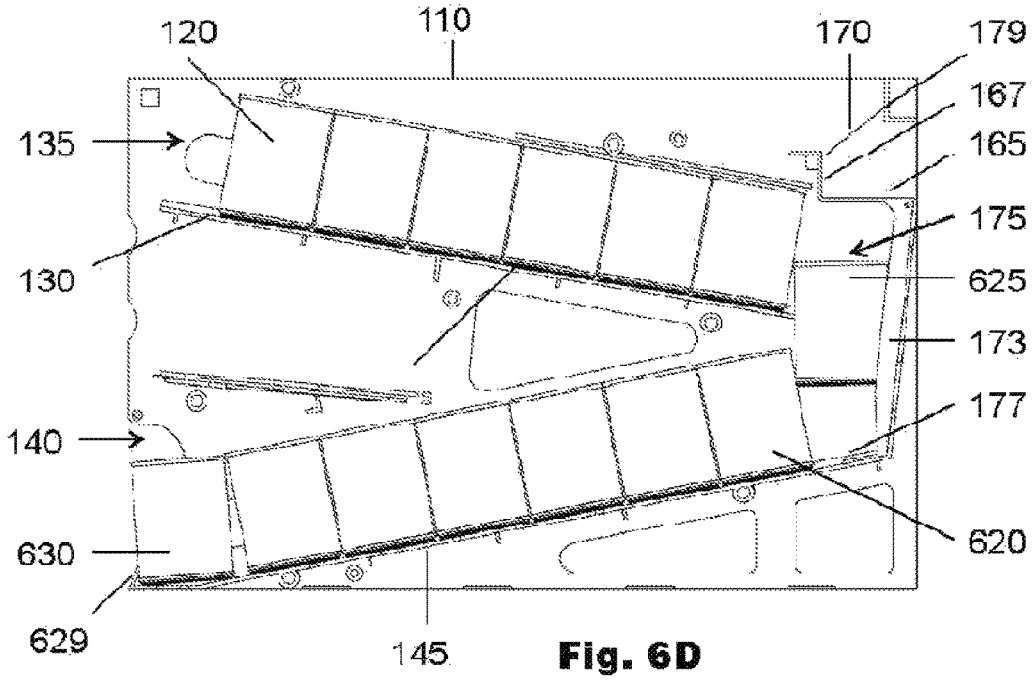

As shown in FIG. 6D, after the immediately preceding can 625 has moved beyond the backstop 167, it then passes through the opening 175 in the ramp 130 of the upper chamber 135 into the intermediate position. As discussed above with respect to FIG. 6A, the movement of this can 625 into the intermediate position causes the movable backstop 167 to return to its stopping position, thereby halting the progression of the cans on the ramp 130 of the upper chamber 135 so that only one can passes through the opening 175 at a time. At the end of the movement cycle, a new can 630 is in the dispensing position 125, and there is one fewer can on the ramp 130 of the upper chamber 135. The movement cycle can continue until all of the cans in the slot have been removed by consumers.

The movement of cans 120 during loading of the slot 110 is similar to the movement cycle during dispensing of the can to a consumer. If the slot is empty of cans, or nearly empty, then the backstop 167 will be in its upper position due to the action of the elastic member 170, i.e., the position depicted in FIG. 6C. This will allow newly-loaded cans 120 to pass down the entire ramp 130 of the upper chamber 135 and through the opening 175 to the lower chamber 140. As each can passes through the intermediate position, it will cause the movable backstop 167 to return to its stopping position, thereby halting the progression of additional newly-loaded cans which may be present on the ramp 130 of the upper chamber 135 so that only one can passes through the opening 175 at a time. The newly-loaded cans will continue to pass down to the lower chamber 140 until the lower chamber ramp 145 is fully loaded with cans 120, as depicted in FIG. 6D.

Figure 7:
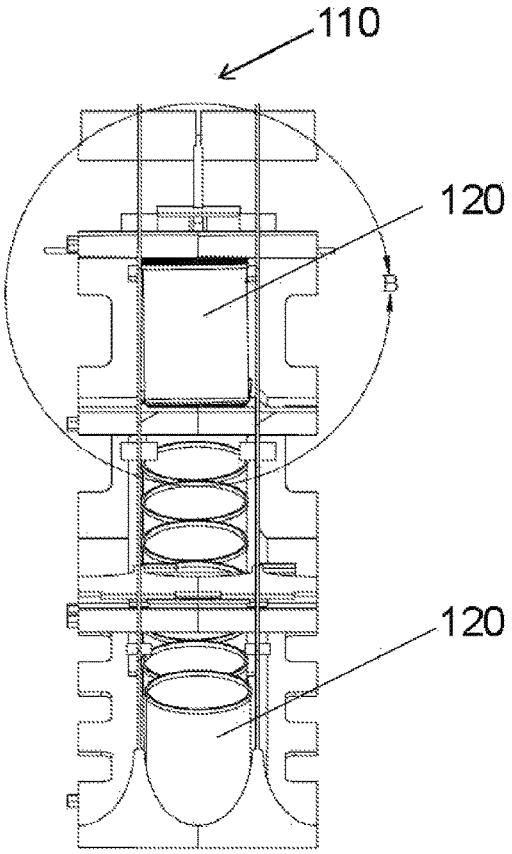
FIG. 7 shows a front view of one slot of the can dispenser and merchandiser loaded with cans as seen along a longitudinal direction of the ramp of the upper chamber.
Figure 8:
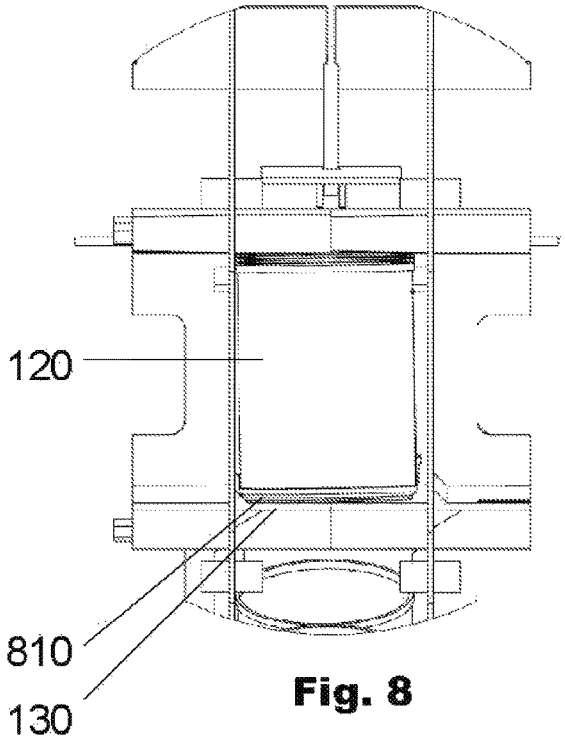
FIG. 8 shows an enlargement of a portion of the slot depicted in FIG. 7 in the vicinity of the ramp of the upper chamber.

FIG. 7 shows a front view of one slot 110 of the can dispenser and merchandiser loaded with cans 120 as seen along a longitudinal direction of the ramp 130 of the upper chamber 135. FIG. 8 shows an enlargement of a portion of the slot depicted in FIG. 7 in the vicinity of the ramp 130 of the upper chamber 135. As can be seen in these figures, the cans 120 loaded into the upper chamber 135 (and, analogously, those loaded in the lower chamber 140) are tilted in a sideways direction, i.e., a direction transverse (i.e., a direction parallel to the plane of FIG. 7) to the longitudinal direction (i.e., a direction orthogonal to the plane of FIG. 7) of the ramp 130. The tilting causes each can to contact the ramp only on one edge 810 of its bottom rim. This configuration causes the cans to roll on the edge of their bottom rims and rotate as they move down the ramp of the upper chamber toward the back of the dispenser.

Figure 9:
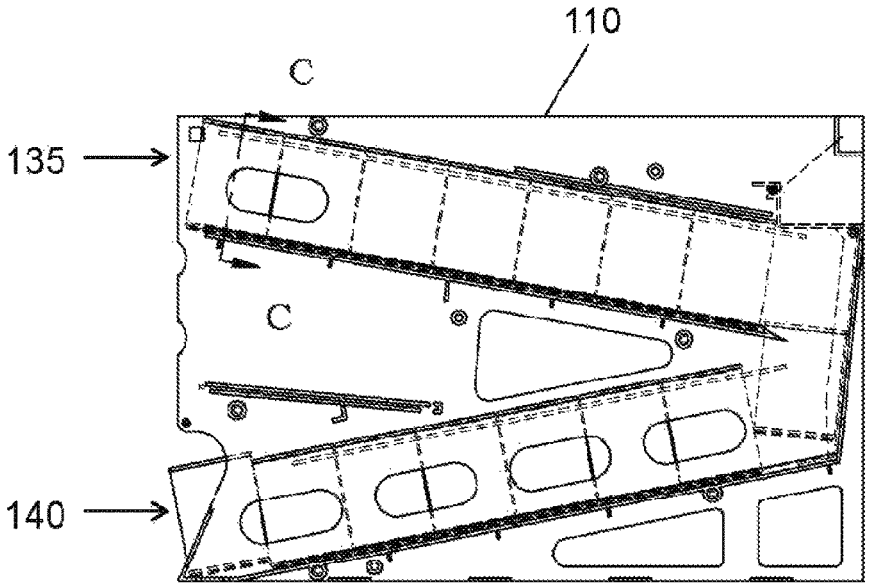
FIG. 9 shows a plan side view of the slot depicted in FIG. 7.
Figure 10:
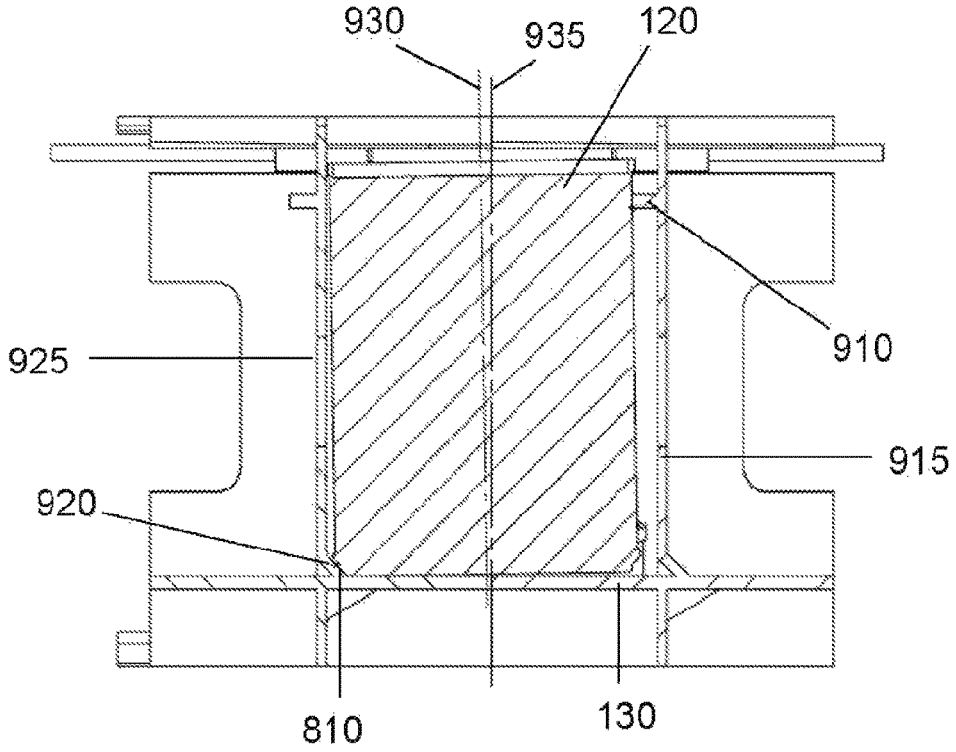
FIG. 10 shows a cross-sectional view (specified by line C of FIG. 9) of a can in a tilted vertical orientation positioned on the ramp of the upper chamber of the slot depicted in FIG. 7.

FIG. 9 shows a plan side view of the slot 110 depicted in FIG. 7. FIG. 10 shows a cross-sectional view (specified by line C of FIG. 9) of a can 120 in a tilted vertical orientation positioned on the ramp of the upper chamber of the slot depicted in FIG. 7. As shown in these figures, the tilting of the cans 120 may be provided by one or more guide ribs (910, 920) which run along sides of the upper chamber 135 in the longitudinal direction of the upper chamber ramp 130. In this particular example, a guide rib 910 is provided on the right sidewall 915 of the slot near the top of the upper chamber 135. The right-hand guide rib 910 has a rectangular cross-section, although other shapes, e.g., a protrusion with a rounded end, may also be used. A corresponding guide rib 920 is provided on the left side wall 925 of the slot 110 in the lower left-hand corner of the upper chamber 135. In this example, the left-hand guide rib 920 has a triangular cross section and is positioned in the corner of the upper chamber 135, although other shapes and positions may be used.

The tilt angle of the axis 930 of the can 120 relative to the vertical direction 935 is determined by the relative size and position of the guide ribs (910, 920), the size of the can 120, and the size of the upper chamber 135. It can be seen that the width of the space between the guide ribs (910, 920) is less than the width, i.e., diameter, of the can 120. Therefore, the can 120 must be tilted to fit between the guide ribs (910, 920). The tilt angle is sufficient to lift the bottom of the can so that only one edge of the bottom of the can contacts the ramp. This, in turn, largely eliminates the frictional force between the bottom of the can and the ramp and results in a largely rotational/rolling of the cans about each can's vertical, i.e., cylindrical, axis as the can moves down the ramp, rather than a sliding movement (although some sliding of the rim of the bottom of the can may occur as it moves down the ramp).

As explained above, in particular embodiments, systems and a methods may be provided for moving cylindrical or semi-cylindrical objects from one end of a dispensing surface to another end by simultaneously imparting rotational and translational motion to the objects. The objects can be, for example, canned goods or bottles having a cylindrical cross-section. The dispensing surface can be inclined, or positioned on an inclined support, such as a shelf, and include side supports or dividers containing alternating guide ribs to impart rotational motion to the objects as the objects move, under the influence of gravity, along the dispensing surface. A spring-loaded pusher, as is known in the art, can also be provided in particular embodiments to further assist movement of the product down the inclined surface toward a front surface for selection by a consumer. Alternatively, the dispensing surface can be horizontal and contain alternating guide ribs on side supports, and a spring-loaded pusher for urging the product to the front of the dispenser.

It is contemplated that multiple dispenser slots 110 as described herein can be positioned side-by-side on a store shelf and/or in a vertically-stacked arrangement to merchandise canned goods to consumers. It is contemplated that each separate dispenser slot 110 may contain one type of product, such as a particular soup flavor, color of paint, or any other cylindrically or semi-cylindrically or round container-packaged product. It is also contemplated that additional features or modifications of the invention may be readily known to those of ordinary skill in the art. For example, although it is contemplated that the dispenser be formed of injection-molded plastic, other materials may be readily used. Moreover, inventory control means may be included, such as a transparent window on a side of the dispenser to allow store personnel to easily ascertain when product in a particular dispenser is running low and needs to be replenished.

In view of the discussion above, it can be seen that the disclosed embodiments provide a first-in, first-out merchandiser wherein cans rotate, by virtue of guide ribs (910, 920) in alternating high or low positions from one side 915 of the upper chamber 135 to the other side 925, as the can 120 moves along a dispensing path. In an intermediate section of the dispensing path, there is a latch 160, including a reciprocating lever 165, which allows the cans to advance, one at a time, along the dispensing path, and which allows the cans to drop, without jamming, from the upper chamber 135 to the lower chamber 140.

As discussed above, and as shown in FIGS. 6A-6D, embodiments may include a latch 160 in the form of a pivoting lever 165 which allows cans 120 in a slot 110 of the dispenser 100 to be advanced in a vertical orientation along the inclined ramps (130, 145) of the device. The lever 165 is pivotally connected at its fulcrum 169 to the side panel 150 walls, such as, for example, by a snap-fit engagement between an indent on a lever 165 edge, and a boss on the side panels 150, and allows the cans 120 to advance along the path from the upper chamber 135 to the lower chamber 140.

Figure 11:
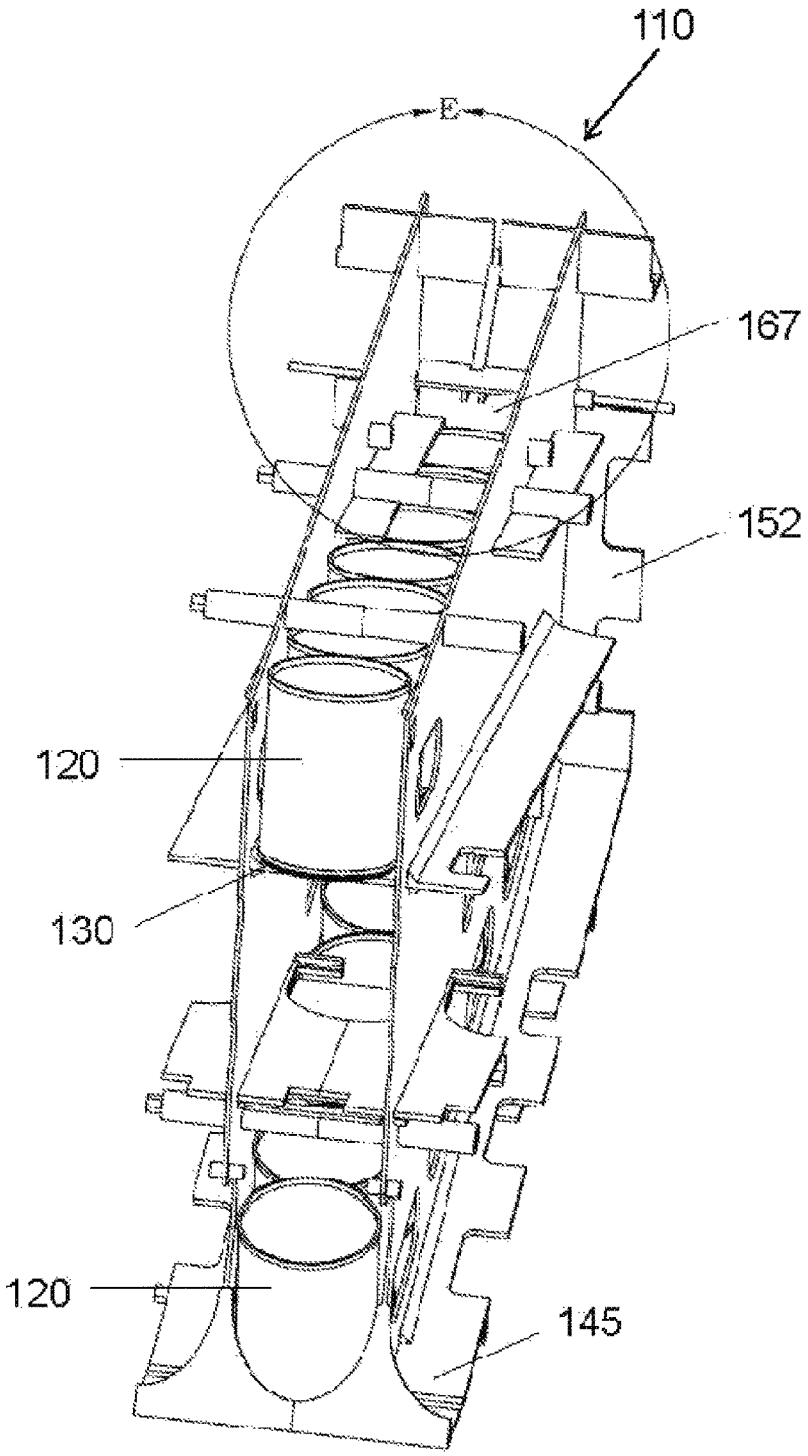
FIG. 11 shows a front perspective view of one slot of the can dispenser and merchandiser loaded with cans.
Figure 12:
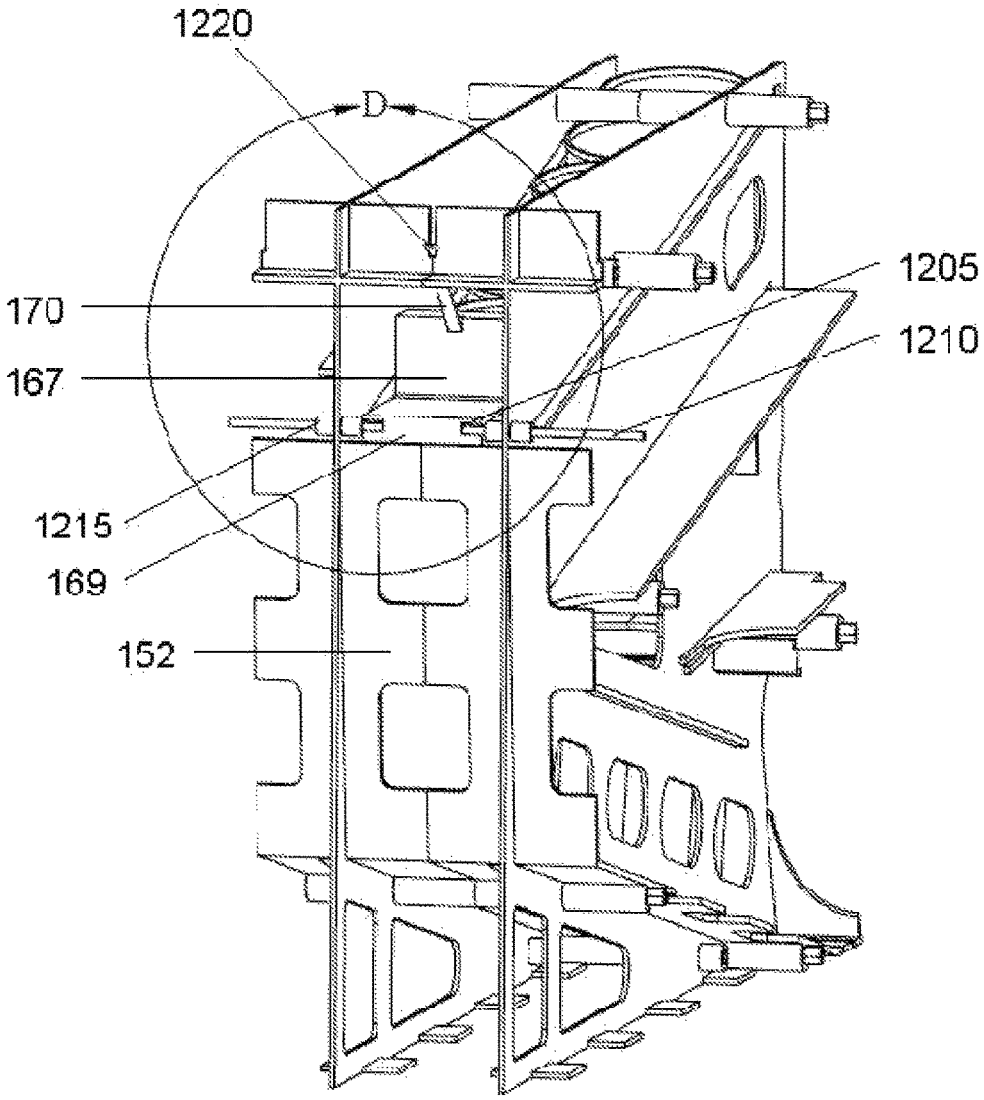
FIG. 12 shows a back perspective view of the slot of the can dispenser and merchandiser loaded with cans depicted in FIG. 11.
Figure 13:
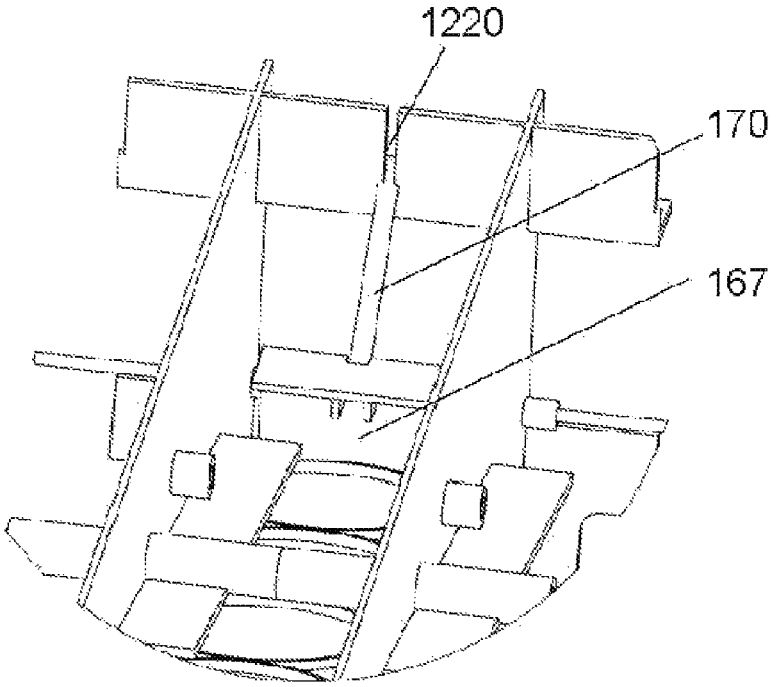
FIG. 13 shows an enlargement of the front of a latch portion of the slot depicted in FIG. 11.
Figure 14:
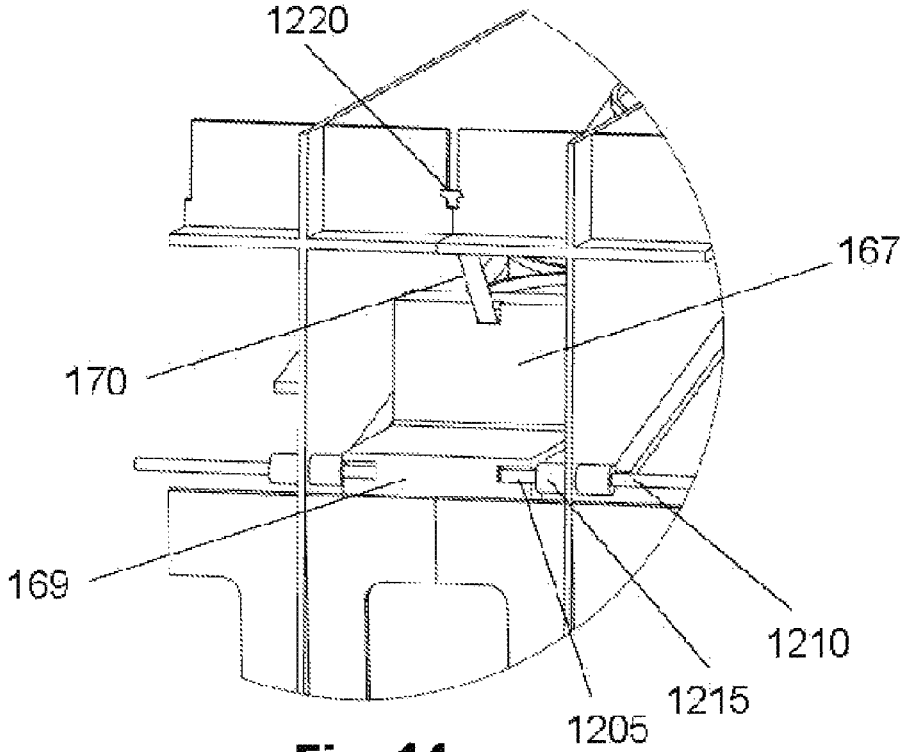
FIG. 14 shows an enlargement of the back of the latch portion of the slot depicted in FIG. 12.

The structure and operation of the latch may be understood by referring, for example, to the following figures of the present application. FIG. 11 shows a front perspective view of one slot 110 of the can dispenser and merchandiser 100 loaded with cans 120. FIG. 12 shows a back perspective view of the slot 110 of the can dispenser and merchandiser 100 loaded with cans 120 depicted in FIG. 11. FIG. 13 shows an enlargement of the front of a latch 160 portion of the slot 110 depicted in FIG. 11. FIG. 14 shows an enlargement of the back of the latch 160 portion of the slot 110 depicted in FIG. 12.

As shown in FIGS. 11-14, the lever 165 is positioned at the back of the dispensing path near a back wall 152 of the slot 110 and includes an actuating portion 173 (see FIGS. 4, 5, and 6A-6D) which extends from the back of the upper chamber 135 down to the ramp 145 of the lower chamber 140. A bottom edge 177 (see FIGS. 4, 5, 6D, and 6D) of the actuating portion 173 (i.e., an "anchor") is positioned at the back of the lower chamber 140, and a moveable backstop 167 portion is positioned at the top portion of the lever 165. At the fulcrum 169 of the lever 165, an indent 1205 is formed which receives an axle 1210 which, in turn, engages a boss 1215 formed on or through the side panel 150, i.e., the divider walls (see FIGS. 12 and 14). The bosses 1215 may have a spacer for offsetting the sides of the lever 165 from the faces, i.e., main surfaces, of the side panels 150. The interaction of the bosses 1215, indents 1205, and axle 1210 provide an axis of rotation of the lever about the axle.

As discussed above, in the upper chamber 135, as cans 120 roll and slide away from the front and reach the back of the upper chamber 135, they make contact with the upper end of the lever 165, i.e., the moveable backstop 167, located inside the upper chamber 135. The reciprocating motion of the moveable backstop 167 regulates and facilitates the flow of cans 120 from the upper chamber 135 to the lower chamber 140.

A slot 1220 is formed on a back panel for securing one end of a leaf/coil variable force elastic element 170, e.g., spring or elastic band. The remainder of the elastic element 170 is positioned in a detail in the backstop 167. The elastic element 170 facilitates the reciprocal motion of the lever 165 during operation, as explained above with respect to FIGS. 6A-6D. The elastic element 170 can easily be replaced in the field, if desired, which gives great flexibility, for example, to use the system with a can of the same size but different weight. Alternatively, there can also be different types of elastic elements 170 used for adjusting the tension applied to the lever.

Although example embodiments have been shown and described in this specification and figures, it would be appreciated by those skilled in the art that changes may be made to the illustrated and/or described example embodiments without departing from their principles and spirit.

What is claimed is:

1. A dispenser for storing and individually dispensing cylindrical containers in a vertical orientation, the dispenser comprising:

an upper chamber having a ramp sloping downward toward a back of the dispenser, the upper chamber being configured to receive the containers loaded in a vertical orientation at a front of the dispenser and which move down the upper chamber ramp by gravity, the upper chamber ramp having an opening at a back end of the dispenser through which the containers pass;

a lower chamber having a ramp sloping downward toward the front of the dispenser and configured to receive the containers passing through the opening in the upper chamber ramp, the containers moving down the lower chamber ramp by gravity to a dispensing position at the front of the dispenser;

a latch positioned at a back portion of the upper chamber which is configured to restrict passage of the containers through the opening in the upper chamber ramp so that the containers pass through the opening one at a time as containers are removed from the dispensing position; wherein the latch comprises a lever having a fulcrum fixed on an axle rod at the back portion of the upper chamber; an elastic element having a first end connected to an upper end of the lever a second end inserted in a slot formed on the back portion of the upper chamber above the fulcrum;

wherein as a first container is removed from the dispenser, the elastic element creates tension which pulls the upper end of the lever upward allowing a second container on the upper ramp to move beyond the upper end of the lever and slide down through the opening of the upper ramp, and the lower end of the lever pivots about the fulcrum backward toward the back of the lower chamber, which in turn, causes the upper end of the lever to move downward into the path of the containers on the upper ramp of the upper chamber to prevent containers from falling into the opening.

2. The dispenser of claim 1, wherein the ramp of the lower chamber is sized to fit a whole number of the containers plus a fractional portion of one of the containers.

3. The dispenser of claim 1, wherein the lower chamber is configured so that a container passing through the opening in the upper chamber ramp lodges in an intermediate position between the upper chamber and the lower chamber when the lower chamber is filled with the containers.

4. The dispenser of claim 1, wherein the elastic element comprises a spring or elastic band.

5. The dispenser of claim 1, wherein the upper chamber is configured to provide a tilt angle, in a direction transverse to the longitudinal direction of the upper chamber, of the vertically-oriented containers as the containers pass through the upper chamber.

6. The dispenser of claim 5, wherein the tilt angle is sufficient to cause each of the containers to contact the ramp of the upper chamber on an edge of a bottom rim of the container to allow rotation of the container as it passes through the upper chamber while maintaining a substantially vertical orientation of the container.

7. The dispenser of claim 5, wherein the tilt angle is between about 0.5 degree and about 5 degrees.

8. The dispenser of claim 5, wherein the tilt angle is between about 1 degree and about 3 degrees.

9. The dispenser claim 1, wherein the upper chamber comprises a first guide rib extending along an upper portion of a first side wall of the upper chamber in a longitudinal direction of the upper chamber, the first guide rib being configured to impart a tilt angle to the containers.

10. The dispenser of claim 9, wherein the upper chamber further comprises a second guide rib extending along a lower portion of a second side wall of the upper chamber in a longitudinal direction of the upper chamber, the second guide rib being configured, in conjunction with the first guide rib, to impart a tilt angle to the containers.

11. The dispenser claim 1, wherein the upper chamber comprises a first guide rib extending along a first side wall and a second guide rib extending along a second side wall of the upper chamber in a longitudinal direction of the upper chamber; and wherein a distance between the first and second guide ribs in a transverse direction of the upper chamber is less than a diameter of the containers.

12. The dispenser claim 1, wherein the dispenser is formed by joining two side panels, each of the side panels having structures extending from at least one face, the structures forming the ramps of the upper and lower chambers.

13. A multiple-slot dispenser for storing and individually dispensing cylindrical containers from each of the slots in a vertical orientation, the multiple-slot dispenser comprising a plurality of the dispensers of claim 1 connected in a side-by-side arrangement.

14. The multiple-slot dispenser of claim 13, further comprising a loading door extending across an upper portion of the slots, the loading door being hinged to provide access to a loading opening at the front of the upper chamber of each of the slots.

15. The multiple-slot dispenser of claim 13, wherein each of the slots is formed by joining two side panels, each of the side panels having structures extending from at least one face, the structures forming the ramps of the upper and lower chambers of each slot.

16. The multiple-slot dispenser of claim 15, wherein internal ones of the side panels each have structures extending from both faces thereof, the structures of adjacent ones of the internal side panels forming, in conjunction, the ramps of the upper and lower chambers of the slots formed between the internal side panels.

* * * * *